US007736065B2

(12) United States Patent
Fietz

(10) Patent No.: US 7,736,065 B2
(45) Date of Patent: Jun. 15, 2010

(54) SUPPORTING DISK FOR PROVIDING BEARING SUPPORT TO A ROTOR OF AN OPEN-ENDED SPINNING MACHINE, AND METHOD FOR MANUFACTURING SAID SUPPORTING DISK

(75) Inventor: Roland Fietz, Neustadt-Momberg (DE)

(73) Assignee: Carl Freudenberg KG, Weinheim (DE)

( * ) Notice: Subject to any disclaimer, the term of this patent is extended or adjusted under 35 U.S.C. 154(b) by 467 days.

(21) Appl. No.: 11/789,955

(22) Filed: Apr. 26, 2007

(65) Prior Publication Data

US 2007/0263951 A1 Nov. 15, 2007

(51) Int. Cl.
*F16C 13/00* (2006.01)
*D01H 1/24* (2006.01)

(52) U.S. Cl. ..... 384/549; 57/103

(58) Field of Classification Search ..... 384/549; 57/103, 405–407

See application file for complete search history.

(56) References Cited

U.S. PATENT DOCUMENTS 4,733,116 A 3/1988 Schulz
4,896,976 A 1/1990 Stahlecker
5,517,814 A * 5/1996 Stahlecker ..... 57/406
6,033,121 A 3/2000 Stahlecker

FOREIGN PATENT DOCUMENTS

| | | | |
|---|---|---|---|
| DE | 3719445 | A1 | 12/1988 |
| DE | 4019029 | A1 | 12/1991 |
| DE | 10027036 | A1 | 12/2001 |
| JP | A60-119231 | | 6/1985 |
| JP | A247319 | | 2/1990 |
| JP | A242070 | | 3/1990 |
| JP | B648200 | | 6/1994 |

* cited by examiner

*Primary Examiner*—Thomas R Hannon
(74) *Attorney, Agent, or Firm*—Pearl Cohen Zedek Latzer, LLP

(57) ABSTRACT

A supporting disk for providing bearing support to a rotor of an open-end spinning machine, the supporting disk including a bearing ring and a supporting ring which is made of an elastic polymeric material and mounted on the periphery of the bearing ring. The bearing ring has a side ring on at least one of the sides of its outer edge. The side ring is located at a distance from the outer edge, connected to the bearing ring via holding members, and is also provided with a supporting ring on its periphery.

19 Claims, 3 Drawing Sheets

SUPPORTING DISK FOR PROVIDING BEARING SUPPORT TO A ROTOR OF AN OPEN-ENDED SPINNING MACHINE, AND METHOD FOR MANUFACTURING SAID SUPPORTING DISK

This application claims priority to European Patent Application EP 06 009 401.8-1256, filed May 6, 2006, and hereby incorporated by reference herein.

BACKGROUND

A drive which drives a rotor of an open-end spinning machine via a pair of supporting disks is known from German Patent Application DE 37 19 445 A1. Also described therein is the basic design of a supporting disk. The supporting disks have bearing rings on the periphery of which are mounted supporting rings made of polymeric material. To improve heat dissipation, the supporting ring is provided with a cooling groove in the central region thereof.

Another way of removing heat is described in DE 100 27 036 C2, wherein the supporting disk is made up of at least two axially touching sub-disks which are partially axially spaced apart by webs, thereby defining cavities extending to the periphery of the supporting disk. At least one of these sub-disks has axial openings through which air is drawn into the cavities during rotation of the supporting disk. After the air has passed through the cavities, it is expelled radially at the periphery. This measure reduces the thermal load on the supporting disk and on the rotor. However, such a supporting disk is relatively expensive to manufacture, and there is a risk of dirt and lint accumulating in the cavities, which may result in uneven rotation of the supporting disk and cause damage to the product or to the spinning machine.

SUMMARY OF THE INVENTION

The present invention relates generally to a supporting disk for providing bearing support to a rotor of an open-end spinning machine, and particularly to a supporting disk including a bearing ring and a supporting ring which is made of an elastic polymeric material and mounted on the periphery of the bearing ring.

Supporting disks used for providing bearing support to rotors of open-end spinning machines are required to meet high standards because they are subjected to high dynamic loads and are expected to have a high thermal resistance. In addition, more and more importance is being attached to the energy demand of the spinning machine, which has a significant impact on the operating costs of the spinning machine. Therefore, efforts are made to keep wear of the supporting disks as low as possible in spite of the increased rotor speeds. This applies equally to the energy demand.

An object of the present invention is to overcome the disadvantages of the known supporting disks. An additional or alternate object of the present invention is to provide an improved supporting disk which is inexpensive to manufacture and allows significantly higher rotational speeds than have been possible heretofore.

According to the present invention, the supporting disk has a bearing ring that is provided with a side ring on at least one of the sides of its outer edge. Said side ring is disposed at a distance from the outer edge, connected to the bearing ring via holding members, and is also provided with a supporting ring on its periphery. An embodiment of the present invention provides a supporting disk having a bearing ring that is hollowed out on one side, and which is fixedly connected to the side ring via the holding members, having slots which are located in the regions between the individual holding members, and through which cooling air is passed as the supporting disk rotates. The holding members may be suitably shaped for this purpose.

In an embodiment of the present invention, the outer edge of the bearing ring may be formed as a rim, and the side ring may be provided at this outer edge. In this embodiment, the side ring, the bearing ring and the holding members together can be formed into a single part made of one material. This part can be manufactured, for example, by pressure casting, injection molding, or extrusion.

The holding members may be disposed at equal angular intervals from each other. The number of holding members used may be at least three. In an embodiment of the present invention, the holding members may take the form of webs connecting the outer edge of the bearing ring to the side ring. The holding members can be designed in the form of short brackets originating from the bearing ring itself, or from the underside of the outer edge of the bearing ring. However, in a preferred embodiment of the present invention, the holding members can be in the form of impeller vanes extending to the hub of the bearing ring. However, regardless of whether the holding members are in the form of webs, short brackets, or impeller vanes, their surface can be designed and provided with curvatures so as to cause air to pass through the slots in the desired direction. In this process, the supporting disk itself can be cooled from inside and cooling may also be provided to components located in the vicinity thereof, such as the rotor, rolling-contact bearings, brake shoes, and the like. The flow effects lead to lower temperatures in the overall assembly, thus preventing overheating and extending the useful life of the machine components. Depending on the selected design of the holding members, the air flow can be directed either radially outward from the space below the side ring of the disk, or in the opposite direction. Moreover, when arranging the supporting disks in pairs, air flows may be generated in the same or opposite directions.

Both the bearing ring and the side ring can be provided with supporting rings, which can be connected to the bearing ring or to the side ring, respectively, in a generally known manner. The connection may be a force-locking connection or a form-locking connection. In addition, the supporting rings may be provided with profiles, such as grooves, in the radial contact surfaces thereof.

It is advantageous if the bearing ring is manufactured from a plastic material and has a metal sleeve inserted into its hub. This results in an improved fit on the journal. However, the bearing ring, including the side ring, can also be made completely of plastic or metal.

The supporting disk of the present invention has the advantages of good heat dissipation and of being very easy to clean, since all cavities are easily accessible and visible from outside.

The supporting disk can be manufactured by forming a bearing ring with an axially projecting rim on at least one of the sides of its outer edge, said rim being connected to the bearing ring via holding members, and the bearing ring and the rim each being provided with a supporting ring on the peripheries thereof. The rim can then be separated from the bearing ring by cutting through the transition region between the bearing ring and the rim, thereby producing an annular groove which, between the holding members, is open to the space below the rim. The rim then constitutes the side ring. In the case of a supporting disk that is provided with two side rings, a corresponding groove is provided on both sides of the bearing ring. The groove shape remains the same in the regions of the holding members.

BRIEF DESCRIPTION OF THE DRAWING

In the following, the present invention is described in greater detail on the basis of the drawings, in which.

DETAILED DESCRIPTION

Figure 1:
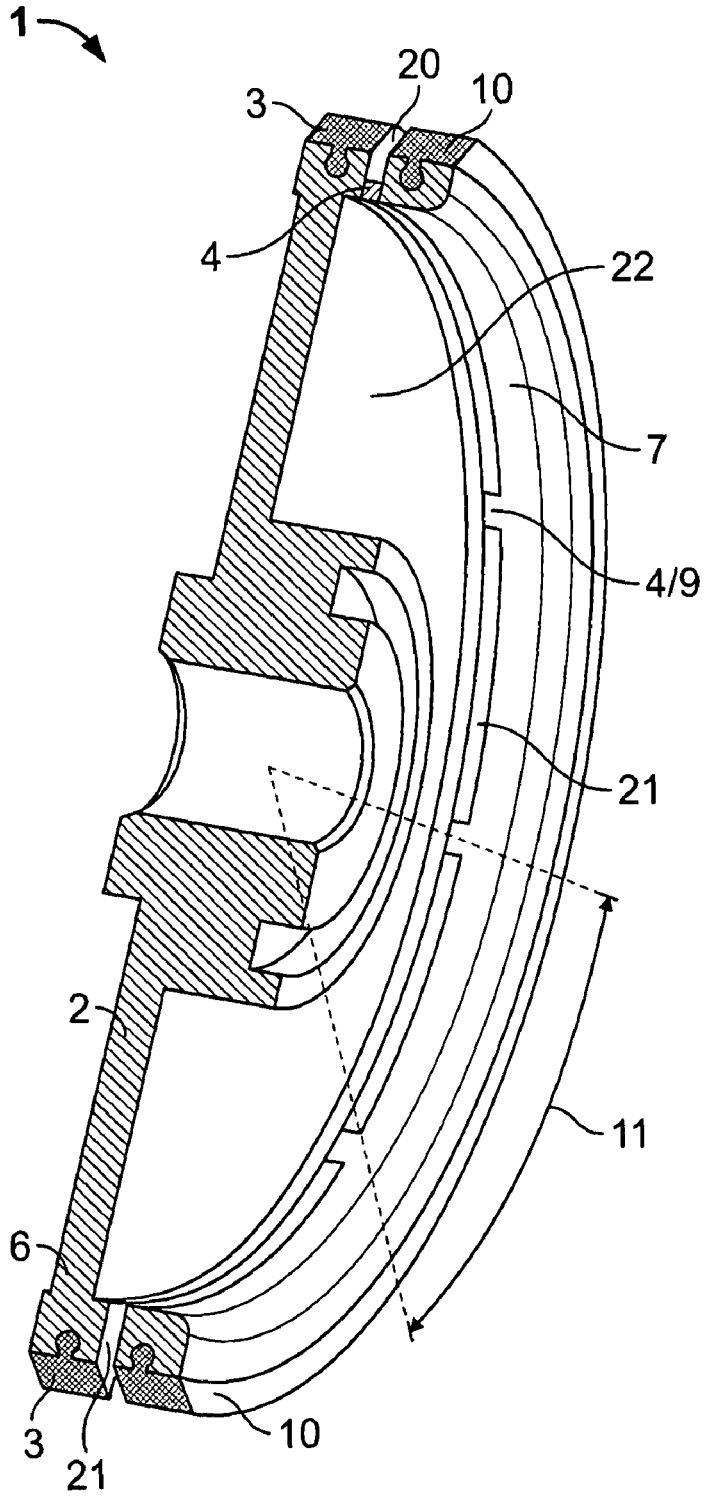
FIG. 1 shows a cross-sectional perspective view of a supporting ring including a bearing ring to which a side ring is connected via webs.

A supporting disk according to the present invention, as shown in FIG. 1 for example, having bearing ring 2 with the supporting ring 3 made of a polymeric material, and the side ring 7, which also has a supporting ring 10. Bearing ring 2 and side ring 7 can form a single part, which can be made by injection molding. The supporting ring and the side ring are connected to each other via holding members 9, which can be in the form of webs 4. The material chosen for supporting rings 3 and 10 can, for example, be polyurethane having a hardness greater than 90 degrees Shore A. The two supporting rings 3 and 10 can be spaced apart by annular groove 20. Annular groove 20 may extend to or into webs 4. In the regions between the individual webs 4, slotted openings 21 can be provided between the outer edge 6 of bearing ring 2 and side ring 7. Space 22 located radially below side ring 7 can open radially outwardly via said slotted openings. Because of this, air can be passed from space 22 to the outside as supporting disk 1 rotates. The volume and direction of the air flow can be predetermined by suitably shaping webs 4. Webs 4 can be disposed at equal angular intervals 11 from each other.

Figure 2:
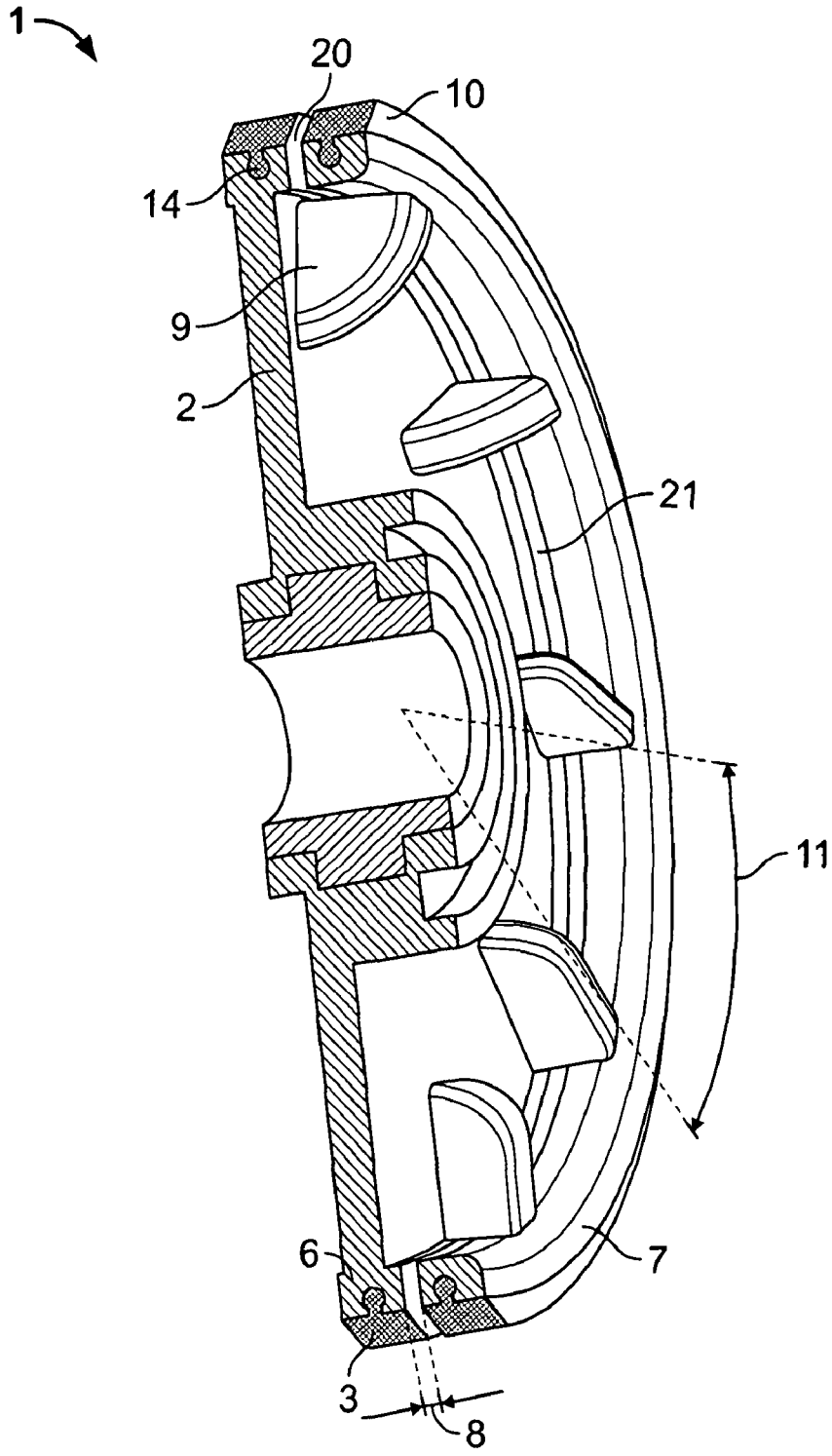
FIG. 2 shows a cross-sectional view of a supporting disk having short brackets.

FIG. 2 shows, for example, that supporting disk 1 can be formed by bearing ring 2 which is provided with supporting ring 3 on the periphery thereof, said supporting ring can be made of an elastic polymeric material. Supporting ring 3 can be chemically bonded to bearing ring 2 anchored in a head-shaped annular groove 14. As shown in FIG. 2, bearing ring 2 can carry side ring 7 on the right side of its outer edge 6. Side ring 7 can be disposed at a distance 8 from the outer edge 6 of bearing ring 2. Side ring 7 can be held to bearing ring 2 via holding members 9, which can be in the form of short brackets 15. Bearing ring 2, side ring 7 and holding members 9 may be manufactured as a single part from one material. Side ring 7 can also be provided with a supporting ring 10 on its periphery, said supporting ring 10 can have the same shape as supporting ring 3 of bearing ring 2. Holding members 9 can be disposed at equal angular intervals 11 from each other. Openings 21 may be made by forming annular groove 20.

Figure 3:
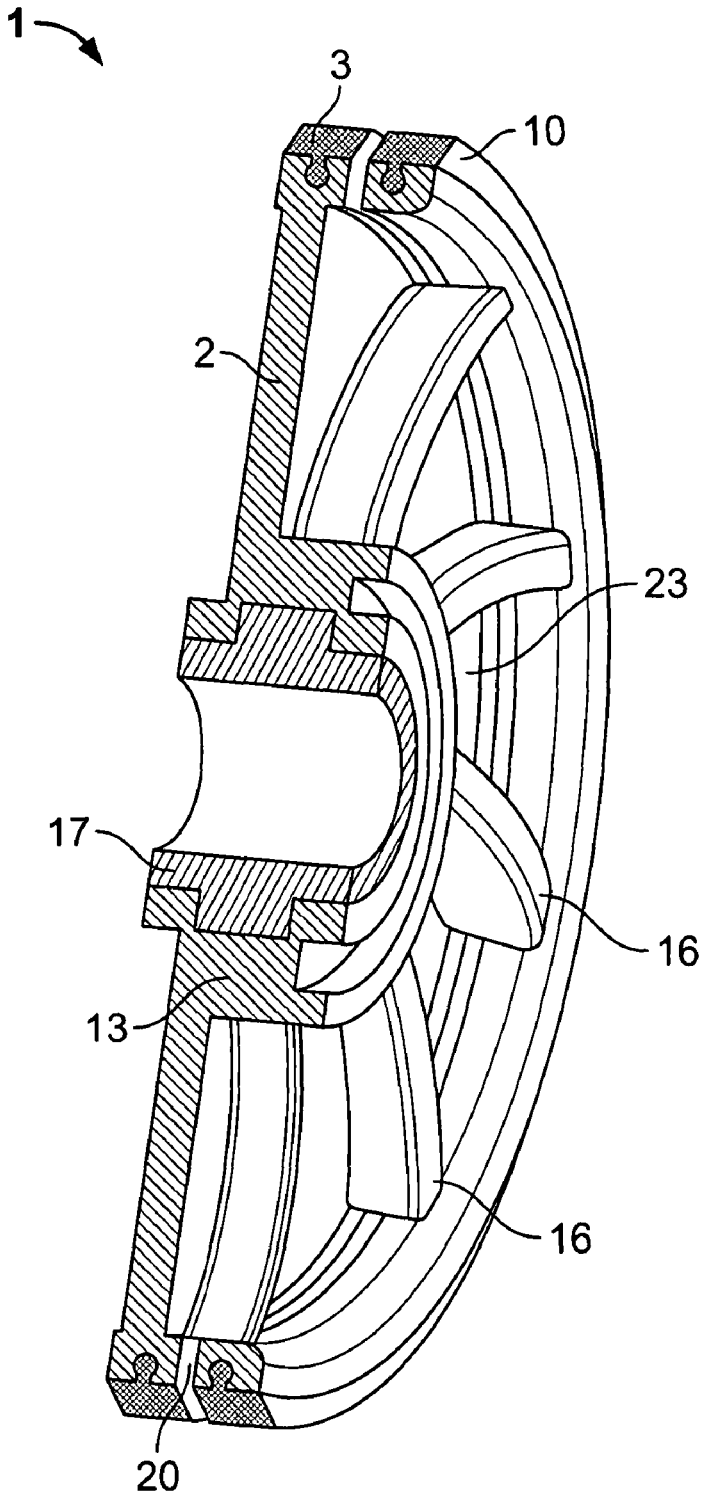
FIG. 3 shows a cross-sectional view showing a supporting disk whose side ring is attached to the bearing ring via impeller vanes.

FIG. 3 shows an embodiment of supporting ring 1, where holding members 9 are in the form of impeller vanes 16. Holding members 9 connect directly to hub 13 of bearing ring 2. Hub 13 is extended in an axial direction. The remainder of the embodiment of FIG. 3 is similar to the embodiment shown in FIG. 2. Supporting rings 3 and 10 can be connected to bearing ring 2 in a form-locking manner. Bearing ring 2 can be made of a plastic material and may also be provided with the metal sleeve 17 in its hub 13.

An inexpensive method of manufacturing a supporting disk of the present invention is by providing bearing ring 2 on at least one of its sides with an axially projecting rim which is connected to bearing ring 2 via holding members 9. Bearing ring 2 and the rim are provided with a supporting ring on the peripheries thereof. Subsequent to that, an annular groove 20 is made between the rim and bearing ring 2 from the outside, said annular groove separating the rim from bearing ring 2 in the regions between holding members 9. Groove 20 is formed such that it can extends to the free space 22 below side ring 7 or, in the case of spoke-like holding members 9, to the free spaces 23 between the spokes or impeller vanes 16. In this manner, slotted openings 21 may be made between holding members 9, through which openings the air can be passed from the inside to the outside or vice versa, depending on the shape of holding members 9.

What is claimed is:

1. A supporting disk for providing bearing support to a rotor of an open-end spinning machine, the supporting disk comprising:

a bearing ring having an outer periphery and an outer edge having a first side;

a first supporting ring on the outer periphery of the bearing ring and being made of an elastic polymeric material;

a side ring on the first side, the side ring being disposed at a distance from the outer edge having a side ring inner periphery and a side ring outer periphery, the side ring inner periphery being radially outside of the inner periphery of the bearing ring so as to define a space radially inside of the side ring inner periphery;

a second supporting ring on the side ring outer periphery; and holding members connecting the side ring to the bearing ring.

2. The supporting disk as recited in claim 1 wherein the bearing ring and the side ring with the holding members constitute a single part made of one material.

3. The supporting disk as recited in claim 1 wherein the holding members are disposed at equal angular intervals from each other.

4. The supporting disk as recited in claim 1 wherein the holding members are webs connecting the outer edge of the bearing ring to the side ring.

5. The supporting disk as recited in claim 1 wherein the holding members are in the form of brackets.

6. The supporting disk as recited in claim 1 wherein the bearing ring has a hub, the holding members designed as spokes connected directly to the hub.

7. The supporting disk as recited in claim 6 wherein the holding members are in the form of impeller vanes.

8. The supporting disk as recited in claim 1 wherein the first and second supporting rings are each connected in a force-locking manner to the bearing ring and to the side ring respectively.

9. The supporting disk as recited in claim 1 wherein the first and second supporting rings are each connected in a form-locking manner to the bearing ring and to the side ring respectively.

10. The supporting disk as recited in claim 1 wherein the first and second supporting rings are provided with profiles in the radial contact surfaces thereof.

11. The supporting disk as recited in claim 1 wherein the bearing ring is made of plastic or metal.

12. The supporting disk as recited in claim 11 wherein the bearing ring is made of aluminum.

13. The supporting disk as recited in claim 1 wherein the bearing ring is made of a plastic material and has a hub, and has a metal sleeve inserted into the hub.

14. The supporting disk as recited in claim 1 wherein the outer edge of the bearing ring is in the form of a rim.

15. The supporting disk as recited in claim 1 wherein the first and second supporting rings are made of an elastic polymeric material having a hardness greater than 90 degrees Shore A.

16. The supporting disk as recited in claim 15 wherein the elastic polymeric material is polyurethane.

17. The supporting disk recited in claim 1 wherein the holding members connect the side ring to the bearing ring so as to define slotted openings radially extending between the side ring and the bearing ring.

18. A supporting disk for providing bearing support to a rotor of an open-end spinning machine, the supporting disk comprising:

a bearing ring having a periphery and an outer edge having a first side;

a first supporting ring on the periphery of the bearing ring and being made of an elastic polymeric material;

a side ring on the first side, the side ring being disposed at a distance from the outer edge having a side ring periphery;

a second supporting ring on the side ring periphery; and holding members connecting the side ring to the bearing ring so as to define slotted openings radially extending between the side ring and the bearing ring.

19. A method for manufacturing a supporting disk for providing bearing support to a rotor of an open-end spinning machine, the supporting disk including a bearing ring and a first supporting ring on a periphery of the bearing ring being made of an elastic polymeric material, and comprising the steps of:

forming the bearing ring with an axially projecting rim on a side of an outer edge, the rim being connected to the bearing ring via holding members, and the rim being provided with a second supporting ring on a rim periphery; and subsequent to the forming step, making an annular groove cutting through a transition region between the bearing ring and the rim, to separate the bearing ring and the rim between the holding members, the annular groove being open to a cavity within the rim.

* * * * *